US005511459A

United States Patent [19]

Hanser et al.

[11] Patent Number: 5,511,459

[45] Date of Patent: Apr. 30, 1996

[54] APPARATUS FOR SYNCHRONIZING LINEAR ACTUATOR MOVEMENT

[76] Inventors: Stacy M. Hanser, 1640 W. George Washington Blvd., Davenport, Iowa 52804; Paul E. Hanser, 1813 Snaggy Ridge Rd., Tipton, Iowa 52772; Leroy A. Van Roekel, 1582 Cedar Muscatine Rd., Wilton, Iowa 52778

[21] Appl. No.: 217,322

[22] Filed: Mar. 24, 1994

[51] Int. Cl.[6] ..... F01B 25/04; F15B 11/22

[52] U.S. Cl. ..... 91/171

[58] Field of Search ..... 91/171, 1

[56] References Cited

U.S. PATENT DOCUMENTS

| | | | |
|---|---|---|---|
| 1,962,924 | 6/1934 | Bristol | 91/171 |
| 3,858,688 | 1/1975 | Galloway | 91/171 |
| 3,872,674 | 3/1975 | Verlinde | 91/171 |
| 4,231,284 | 11/1980 | Smith et al. | 91/171 |
| 4,343,226 | 8/1982 | Ribiero de Almeida | 91/171 |

*Primary Examiner*—F. Daniel Lopez
*Attorney, Agent, or Firm*—Henderson & Sturm

[57] ABSTRACT

An apparatus for synchronizing the extension and retraction of linear actuators. A quadrilateral structure is formed by means of the support base, a pair of actuators, and a crossmember, with a sensor positioned so as to detect variations in the shape of the quadrilateral. The sensor functions in cooperation with the actuator control mechanism to vary power to the actuators in response to the changes in shape which occur due to slight variations in actuator speed of movement.

5 Claims, 9 Drawing Sheets

APPARATUS FOR SYNCHRONIZING LINEAR ACTUATOR MOVEMENT

TECHNICAL FIELD

This invention relates to linear actuators, and more particularly to an apparatus which will synchronize the extension and retraction movements of hydraulic, pneumatic, and electric actuators.

BACKGROUND ART

Linear actuators, whether hydraulic, pneumatic, or electric, are used for a multitude of actions involving moving one structure relative to another. These actuators are often used in pairs due to the size of the structure to be moved, or due to the instability of the structure. However, using a pair of actuators often causes problems due to the inherent difficulty in moving the actuators precisely together. If one actuator moves slightly before the other, or if one actuator moves slightly faster than the other, binding and twisting can occur in the structure being moved.

DISCLOSURE OF THE INVENTION

The present invention teaches an apparatus for synchronizing the extension and retraction of linear actuators. A quadrilateral structure is formed by means of the support base, a pair of actuators, and a crossmember, with a sensor positioned so as to detect variations in the shape of the quadrilateral. The sensor functions in cooperation with the actuator control mechanism to vary power to the actuators in response to the changes in shape which occur due to slight variations in actuator speed or response time.

BRIEF DESCRIPTION OF THE DRAWINGS

FIG. 1A is a perspective view of a mobile home having an extendable room;

FIG. 1B is a perspective view of an underground storage facility having a sliding cover;

FIG. 1C is a perspective view of a warehouse with an entryway having a sliding door;

BEST MODE FOR CARRYING OUT THE INVENTION

Figure 5:
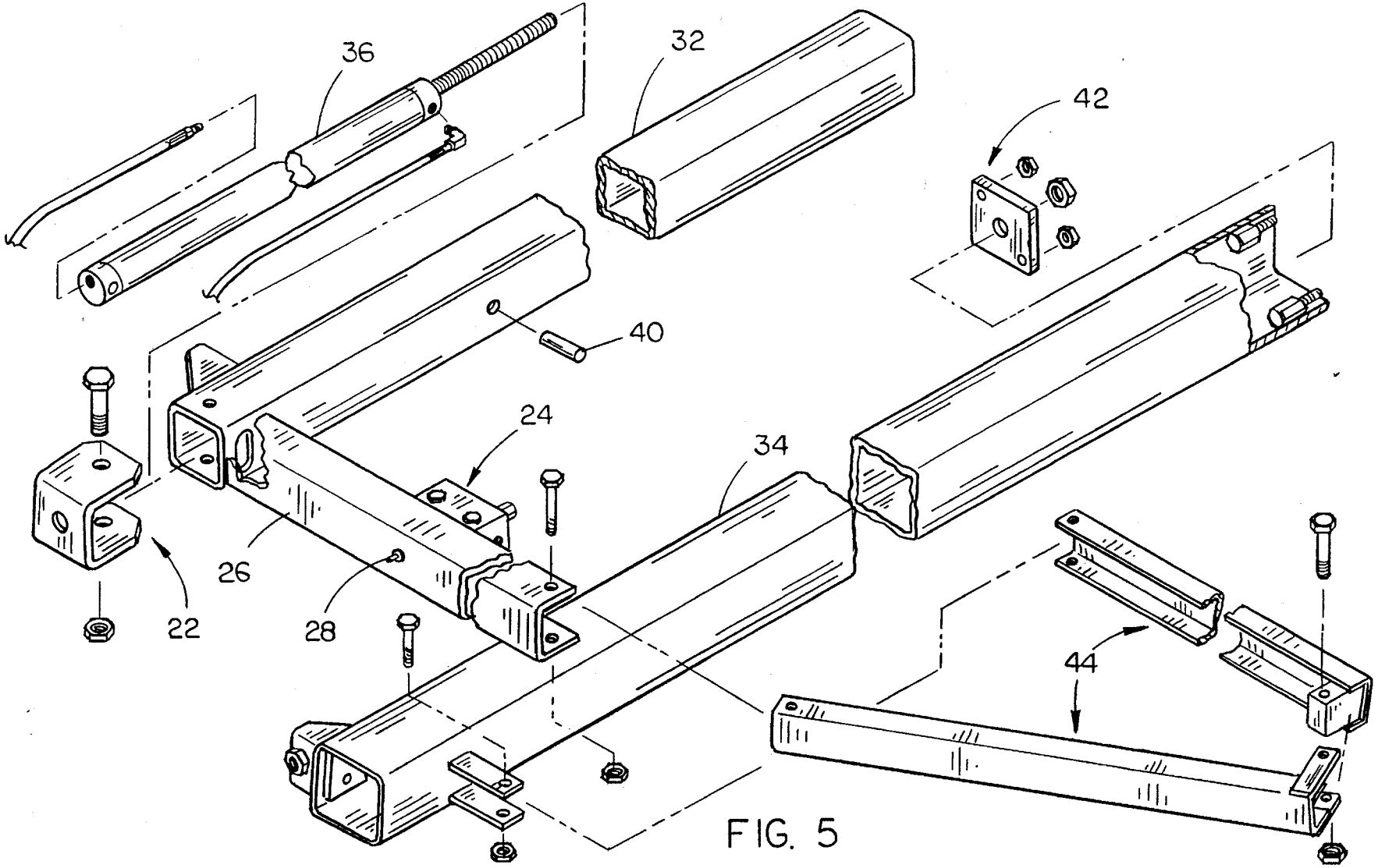
FIG. 5 is an exploded view of one linear actuator and the sensor mechanism of the first embodiment.

Referring now to the drawings, wherein like reference numerals designate identical or corresponding parts throughout the several views, FIGS. 1A, 1B, and 1C depict three potential applications of the present invention. FIG. 1A depicts a mobile home with an extendable living room which is extended and retracted by means of a pair of hydraulic cylinders. FIG. 1B depicts an underground storage bin with a sliding cover which is opened and closed by means of a pair of electric actuators or a pair of hydraulic cylinders. FIG. 1C depicts a warehouse with a sliding door which is opened and closed by means of hydraulic or electric actuators.

Figure 2:
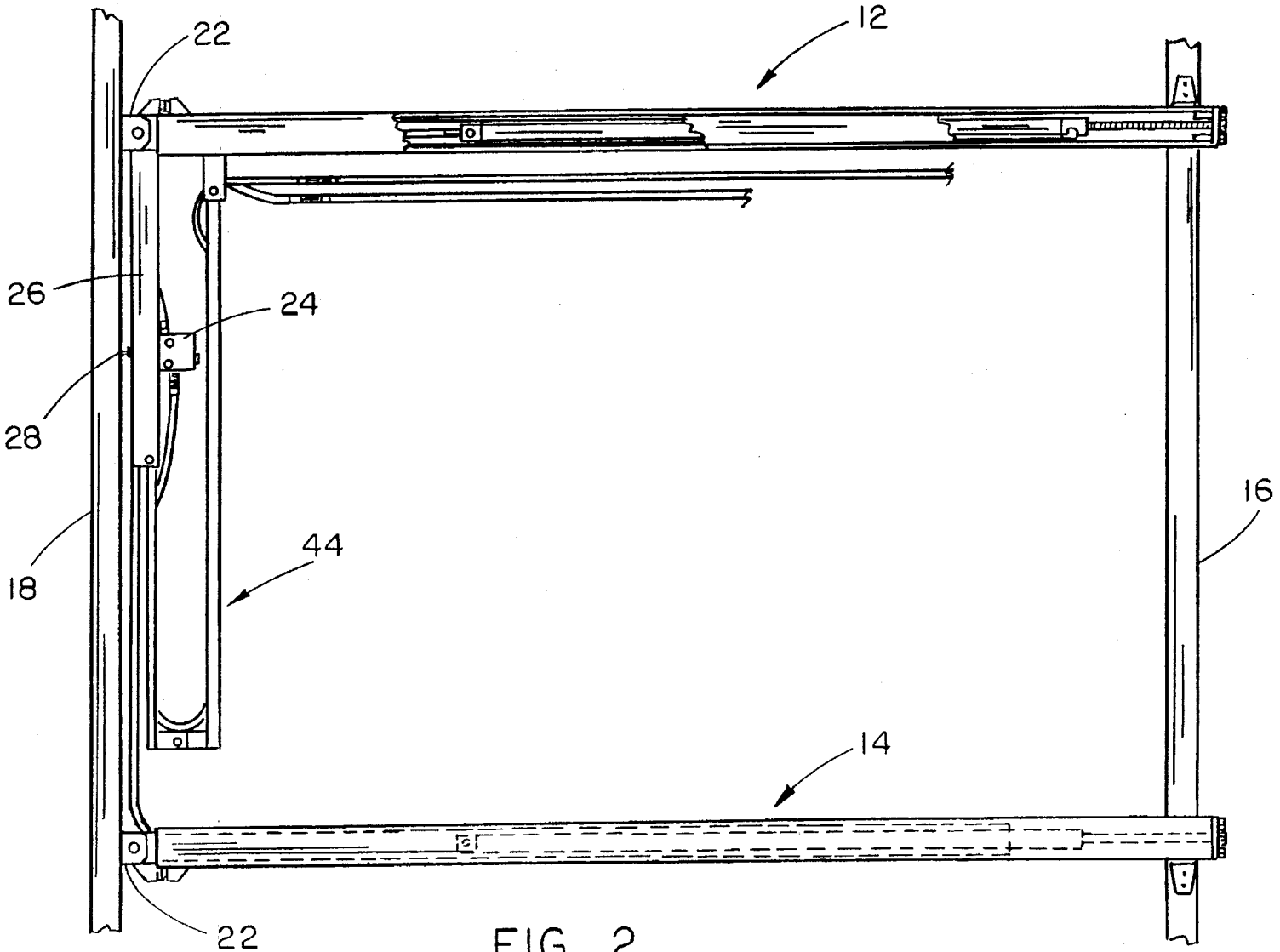
FIG. 2 is a plan view of a first embodiment of the invention in the retracted position.
Figure 3:
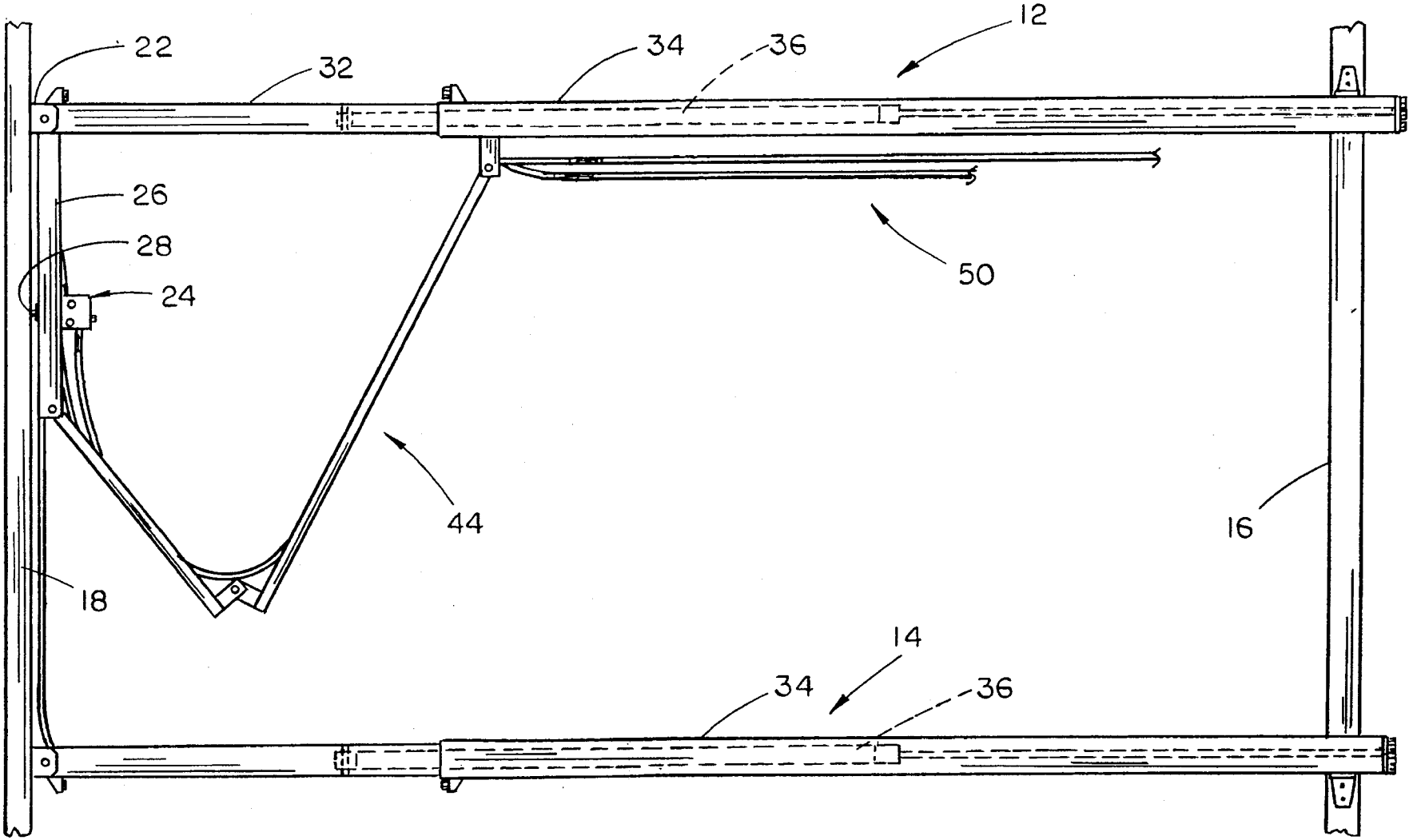
FIG. 3 is a plan view of the first embodiment in the extended position.
Figure 4:
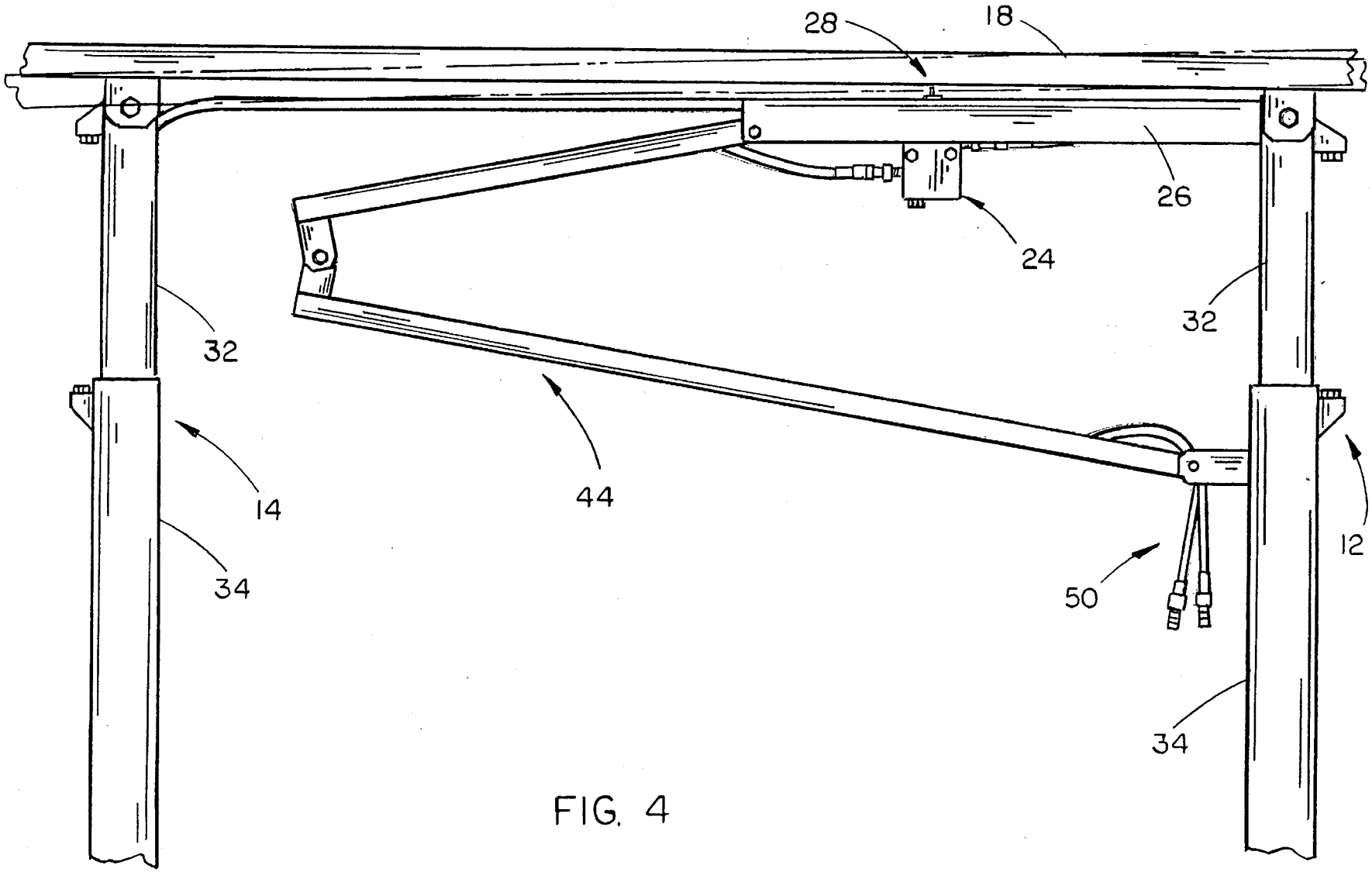
FIG. 4 is an enlarged view of the sensor mechanism and crossmember of the first embodiment.
Figure 5:
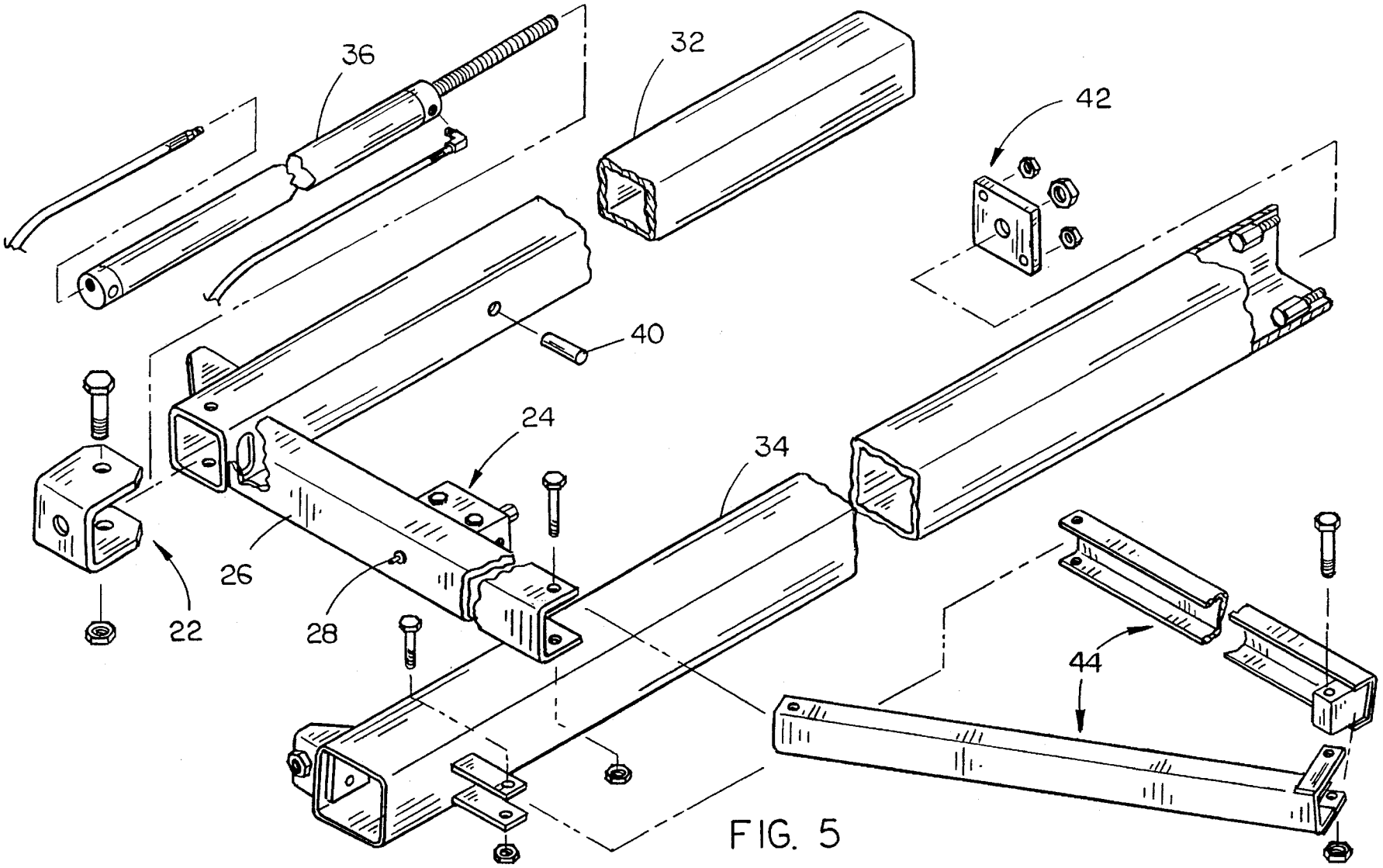

FIGS. 2, 3, and 4 are top plan views of a first embodiment of the invention in which a first actuator 12 and a second actuator 14 are secured to a base, support structure 16 and a crossmember 18, thereby forming a quadrilateral having a particular configuration, in this case a rectangle. In these figures, crossmember 18 is a part of the structure to be moved, as a door or a mobile home extendable room. If such a part of the structure to be moved was not available, the crossmember 18 could otherwise be a rigid bar extending between the free ends of the actuators connecting them together. In either case, the crossmember 18 is pivotally secured to the ends of the actuators 12, 14 by means of a U-bracket and bolt assembly 22. A hydraulic sensor valve 24 is secured to and carried by a sensor arm 26, which is in turn secured to an actuator 12 as by welding. In this particular rectangular configuration, the sensor arm 26 will extend perpendicular to the actuator 12 such that it is adjacent the crossmember 18. The sensor valve 24 has a sensor pin 28 which protrudes from the sensor arm 26 and is in contact with crossmember 18.

Best seen in FIGS. 3, 4, and 5, each of the actuators 12, 14 is comprised of a pair of rectangular tubes 32, 34 fabricated from steel, and a hydraulic cylinder 36. The smaller tube 32 rides within the larger tube 34 from which it may be extended and retracted by the hydraulic cylinder 36. The hydraulic cylinder is secured at its upper end to within the smaller tube 32 by means of a pin 40 (FIG. 5) while the hydraulic piston is secured to the base of the larger tube 34 by means of a base plate assembly 42.

Also depicted is a hydraulic line elbow 44 which is pivotally attached to tube 34 and sensor arm 26 and carries hydraulic lines from the hydraulic controller 60 to the sensor valve 24 and T-fitting 62 (FIG. 6) and serves to protect them during extensions and retractions.

Figure 6:
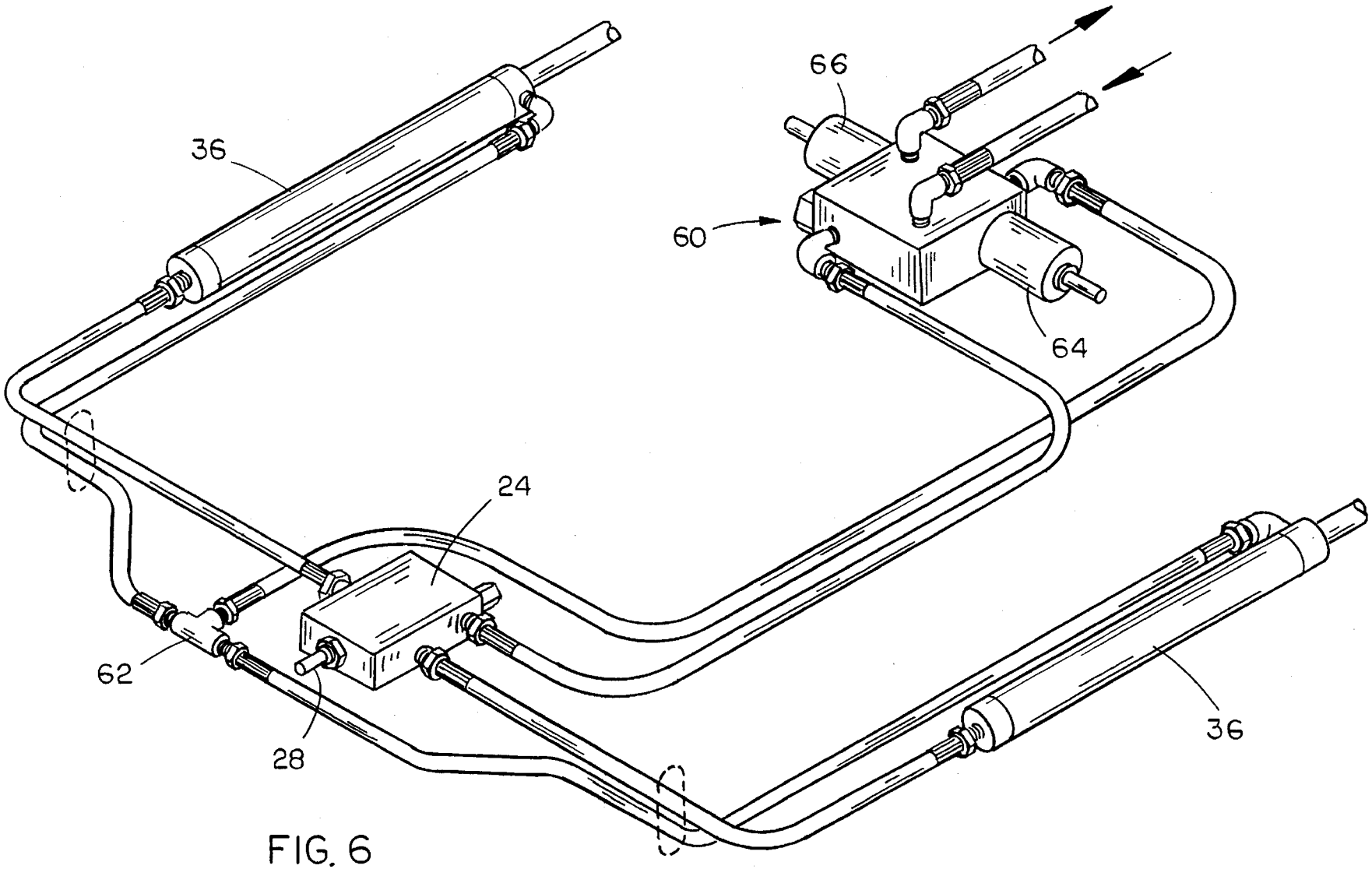
FIG. 6 depicts the hydraulic components of the first embodiment.

FIG. 6 depicts the hydraulic system of the invention wherein hydraulic controller 60 receives hydraulic fluid under pressure from a hydraulic pump (not shown). The controller 60 has an electrically actuated extend solenoid 64 and retract solenoid 66 which permit fluid to pass to the sensor valve 24 and to the hydraulic cylinders 36.

Figure 7:
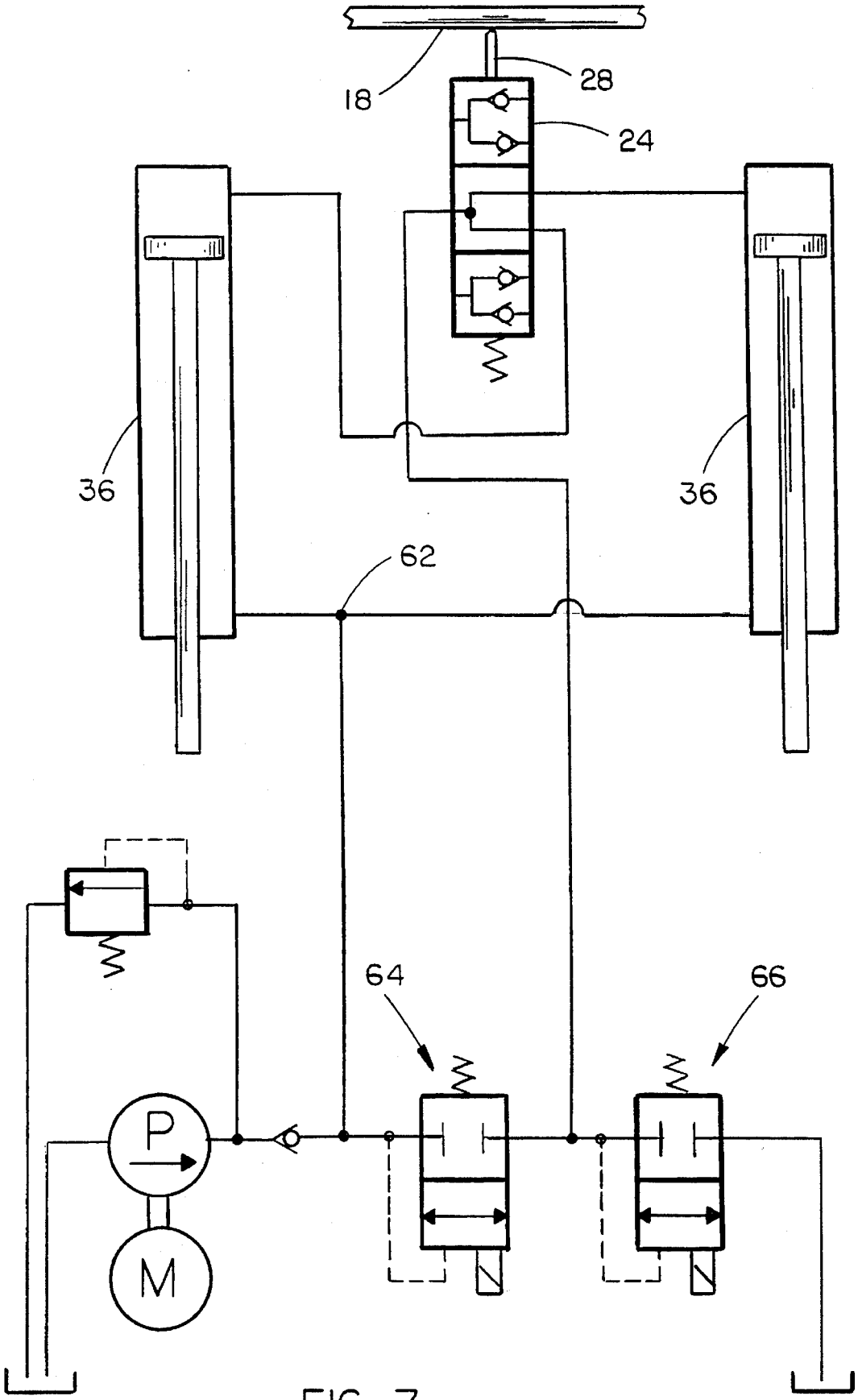
FIG. 7 is a hydraulic schematic diagram of the first embodiment.

FIG. 7 depicts a hydraulic schematic diagram of the invention which should be readily understood by those skilled in the hydraulic arts.

The manner in which the invention functions can be best explained with reference to FIG. 4 in which the actuators are partially extended. If the actuators have moved precisely together, either during extension or retraction, the quadrilateral will remain a perfect rectangle and the crossmember 18 will be perpendicular to the two actuator 12, 14. In this condition, the sensor pin 28 is in a neutral position and hydraulic fluid is equally distributed to or received from the hydraulic cylinders 36 by means of the hydraulic sensor valve 24. During extension, if actuator 12 should get ahead of actuator 14, crossmember 18 will be rotated with respect to the actuators and the quadrilateral will no longer be a rectangle. This action, shown in dashed lines in FIG. 4, will cause the sensor pin 28 on hydraulic sensor valve 24 to be depressed. The sensor valve 24 then stops the transfer of hydraulic fluid to the leading actuator 12, thereby allowing the trailing actuator 14 to catch up. Likewise, if actuator 14 should get ahead of actuator 12, crossmember 18 will be rotated away from sensor arm 26, permitting sensor pin 28 to extend. This action will shut off fluid flow to actuator 14 and continue flow to actuator 12, permitting it to catch up. The invention functions in like manner during retraction.

Figure 8:
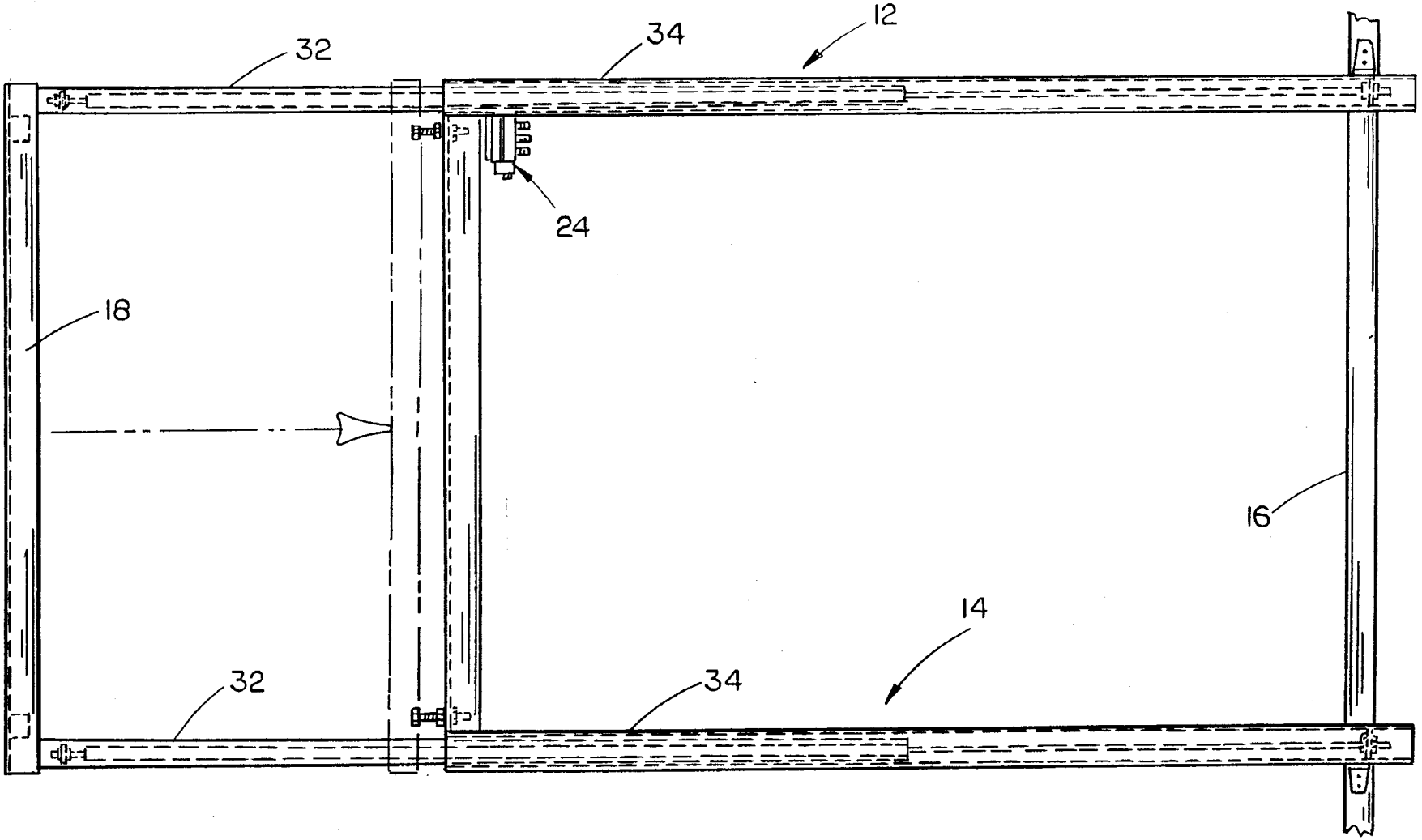
FIG. 8 is a plan view of a second embodiment of the invention.
Figures 9, 10:
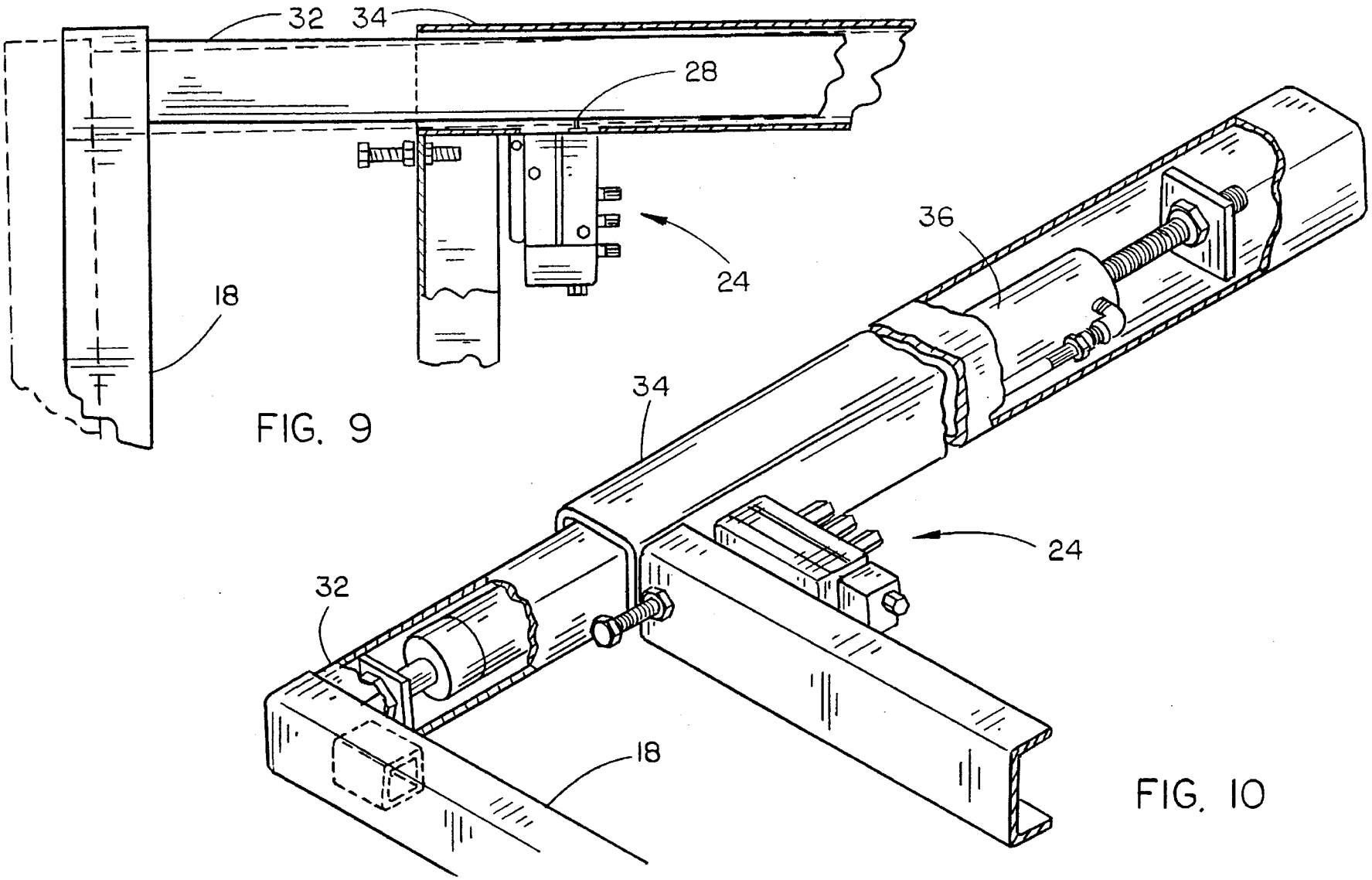
FIG. 9 is an enlarged view of the sensor mechanism and actuator of the second embodiment.
FIG. 10 is a perspective view of a portion of the second embodiment in partial cutaway.

A second embodiment of the invention is shown in simplified form in FIGS. 8, 9, and 10. In this embodiment, crossmember 18 is rigidly secured to the ends of the smaller actuator tubes 32, as by welding. As is best seen in FIG. 9, rigidly securing crossmember 18 to the actuator tubes 32 will inhibit the rotating action of the crossmember 18 that is required in the first embodiment. Therefore, in the second embodiment, the larger actuator tube 34 is slightly larger with respect to the smaller actuator tube 32, thereby permitting some lateral motion of the smaller tube within the larger tube. During extensions and retractions, if one actuator gets ahead of the opposite actuator, the smaller actuator tubes will tend to move laterally within the larger tube, as is depicted in dashed lines in FIG. 9. This movement will be noted by sensor valve 24 which has a sensor pin 28 in contact with the smaller actuator tube 32 through an aperture cut into the larger tube 34. The sensor valve 24 then directs the flow of hydraulic fluid to and from the hydraulic cylinders 36 in response to this lateral movement which equalizes the extension and retraction of the actuators.

While the preceding description has focused on a hydraulically actuated system, this disclosure is intended to cover pneumatic and electrical embodiments as well. A pneumatic system would function almost identically with the hydraulic system. An electrical system would utilize electrical actuators of perhaps the screw type or chain driven type. The sensor would comprise electrical switches or potentiometers which would control the flow of electricity to the actuators, thereby controlling their extension and retraction.

Obviously, many modifications and variations of the present invention are possible in light of the above teachings. It is therefore to be understood that, within the scope of the appended claims, the invention may be practiced otherwise than as specifically described.

I claim:

1. An apparatus for equalizing the movement of linear actuators, comprising:

(a) a support structure;

(b) a first actuator and a second actuator, each having a first portion, and a second portion moveable relative to the first portion; and further having a base end on the first portions secured to said support structure, and an actuation end on the second portions;

(c) a crossmember connecting the actuation end of said first actuator to the actuation end of said second actuator whereby a quadrilateral is formed by said support structure, said crossmember, and said first and second actuators;

(d) an arm member projecting outwardly from the second portion of said first actuator and disposed in a generally parallel fashion and in close proximity to said crossmember;

(e) sensor means consisting of a single sensor for determining when a change in the shape of the quadrilateral occurs wherein the single sensor is secured to said arm member into moveable contact with the crossmember and wherein said crossmember is pivotally connected to the actuation ends of said actuators and said single sensor comprises means for detecting angular displacement of said crossmember relative to said actuators; and (f) means for powering said actuators in response to said single sensor.

2. The apparatus as recited in claim 1 wherein said sensor means further comprises a hydraulic equalizing valve.

3. An apparatus for equalizing the movement of linear actuators, comprising:

(a) a support structure;

(b) a first actuator and a second actuator, each having a first portion, and a second portion moveable relative to the first portion, and further having a base end on the first portions secured to said support structure, and an actuation end on the second portions;

(c) a crossmember connecting the actuation end of said first actuator to the actuation end of said second actuator whereby a quadrilateral is formed by said support structure, said crossmember, and said first and second actuators;

(d) sensor means for determining when a change in the shape of the quadrilateral occurs wherein the sensor means are fixedly mounted relative to the crosspiece member and disposed in moveable contact with respect to the first portion of said first actuator wherein said crossmember is fixedly secured to the actuation ends of said actuators; and, said sensor means comprises means for detecting lateral displacement of the second portion relative to the first portion of said first actuator; and (e)means for powering said actuators in response to said sensor means.

4. The apparatus as in claim 3; wherein, the second portion of the first actuator is provided with an elongated aperture in open communication with the first portion of the first actuator and said sensor means is dimensioned to be received in said elongated aperture.

5. The apparatus as recited in claim 3 wherein said sensor means further comprises a hydraulic equalizing valve.

* * * * *